United States Patent [19]

McMahan et al.

[11] Patent Number: 4,851,976

[45] Date of Patent: Jul. 25, 1989

[54] HEADLAMP BULB RETAINING ARRANGEMENT

[75] Inventors: David R. McMahan; William E. Nagengast, both of Anderson, Ind.; John D. Geddie, East Lansing, Mich.

[73] Assignee: General Motors Corporation, Detroit, Mich.

[21] Appl. No.: 302,288

[22] Filed: Jan. 27, 1989

[51] Int. Cl.[4] ..... H01R 33/00

[52] U.S. Cl. ..... 362/226; 362/61; 362/306

[58] Field of Search ..... 362/61, 226, 306, 435, 362/436, 443, 444

[56] References Cited

U.S. PATENT DOCUMENTS

| | | | |
|---|---|---|---|
| 4,513,356 | 4/1985 | Mikola | 362/226 |
| 4,590,542 | 5/1986 | Schauwecker et al. | 362/226 X |
| 4,679,128 | 7/1987 | Van Duyn et al. | 362/226 X |
| 4,794,500 | 12/1988 | Bradley | 362/61 X |

*Primary Examiner*—Ira S. Lazarus
*Assistant Examiner*—P. Neils
*Attorney, Agent, or Firm*—Edward J. Biskup

[57] ABSTRACT

A retaining arrangement for a replaceable bulb mounted in a vehicle headlamp reflector that includes a grip member and a cooperating lock nut the former of which is adapted to be press fitted onto and retained by spring fingers on a cylindrical boss surrounding the socket formed in the headlamp reflector.

2 Claims, 3 Drawing Sheets

HEADLAMP BULB RETAINING ARRANGEMENT

This invention concerns vehicle headlamps and more particularly relates to a retaining arrangement for maintaining a replaceable light bulb within a socket formed in the rear of a headlamp reflector.

U.S. Pat. No. 4,679,128, which issued on July 7, 1987 and is assigned to the assignee of this invention, discloses a retaining arrangement used with a headlamp bulb having an annular flange and with a reflector having a socket defined by a cylindrical boss formed with an opening for receiving the bulb having the flange located in a predetermined angular position in engagement with the terminal end of the boss. The retaining arrangement includes a grip member comprising a metal ring having a plurality of blades extending radially inwardly therefrom for permitting the grip member to be press fitted on the boss and maintained thereon. A plurality of circumferentially spaced plastic lock tabs are molded onto the peripheral surface of the metal ring and the lock tabs cooperate with a plurality of cam slots formed in a plastic lock nut so when the latter is mounted on the grip member the cam slots receive the lock tabs after which the lock nut is rotated causing the lock nut to move as a unit axially towards the grip member and be locked thereto. In addition, a plurality of radially inwardly extending metal spring fingers are fastened to the lock nut and are adapted to engage the flange of the light bulb and press the flange into firm engagement with the terminal end of the boss.

The present invention concerns a headlamp bulb retaining arrangement that is similar to the above retaining arrangement but differs therefrom in that the grip member, rather than being formed with rigid lock tabs that cooperate with cam slots in the lock nut, is formed with a plurality of circumferentially spaced spring arms that are integral with the metal ring portion of the grip member. By so doing, the lock nut, which cooperates with the grip member for pressing the flange of the bulb into engagement with the terminal end of the boss on the reflector, can dispense with the separate but fastened spring fingers heretofore provided and, instead, be formed as a single part having a rigid annular edge that abuts the flange of the bulb for maintaining the latter in engagement with the terminal end of the boss formed on the reflector.

The objects of the present invention are to provide a new and improved retaining arrangement for a replaceable light bulb mounted in a headlamp reflector and that includes a single piece lock nut and a single piece grip member the latter of which is adapted to be press fitted onto a cylindrical boss integrally formed on the rear of the headlamp reflector; to provide a new and improved retaining arrangement for a replaceable light bulb that includes a grip member in the form of a metal ring having a plurality of radially inwardly extending blades which are adapted to cut into the cylindrical outer surface of a boss formed in the rear of a headlamp reflector so as to permit the grip member to be firmly secured to the boss and also having a plurality of circumferentially spaced spring arms integrally formed with the metal ring that cooperate with a rigid annular portion of a lock nut for retaining the light bulb within a socket defined by the boss; and to provide a new and improved retaining arrangement for a replaceable light bulb that includes a metal ring-like grip member mountable on a cylindrical boss of a headlamp reflector and having a plurality of circumferentially spaced generally L-shaped spring arms which cooperate with a lock nut having a rigid annular contact edge that is adapted to abut the flange of a replaceable light bulb for pressing the latter into firm engagement with the terminal end of a circular boss surrounding the bulb opening at the rear of a reflector.

Other objects and advantages of the present invention will be apparent from the following detailed description when taken with the drawings in which.

Figure 1:
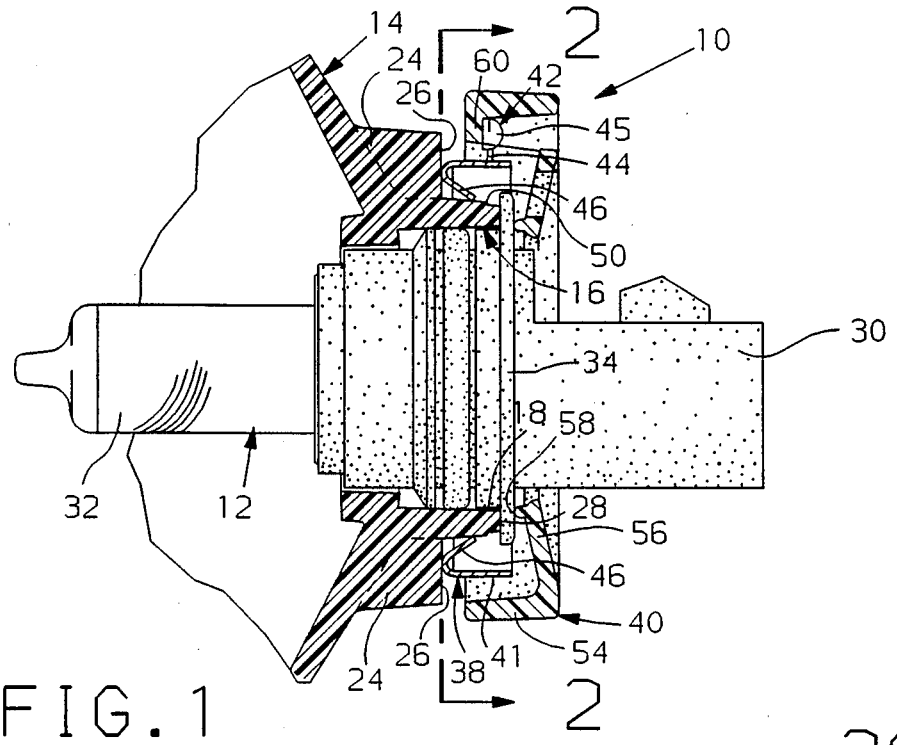
FIG. 1 is an elevational view partially in section showing a retaining arrangement according to the present invention maintaining a replaceable light bulb in the socket of a headlamp reflector.
Figure 2:
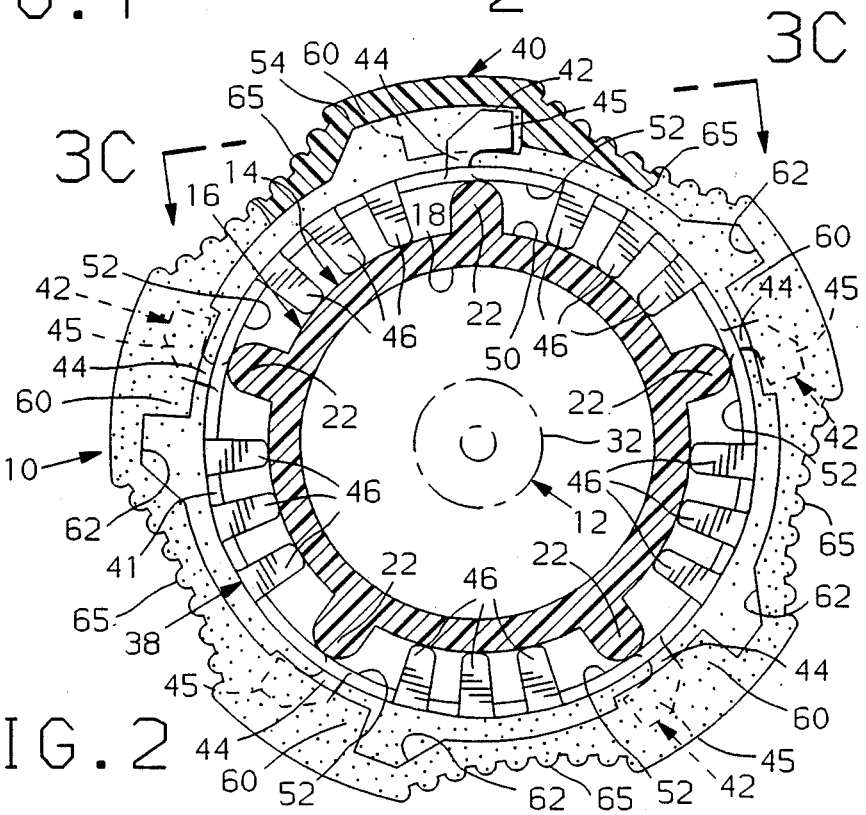
FIG. 2 is a rear view taken on line 2—2 of FIG. 1 of the grip member and lock nut which forms the retaining arrangement shown in FIG. 1.
Figure 3A:
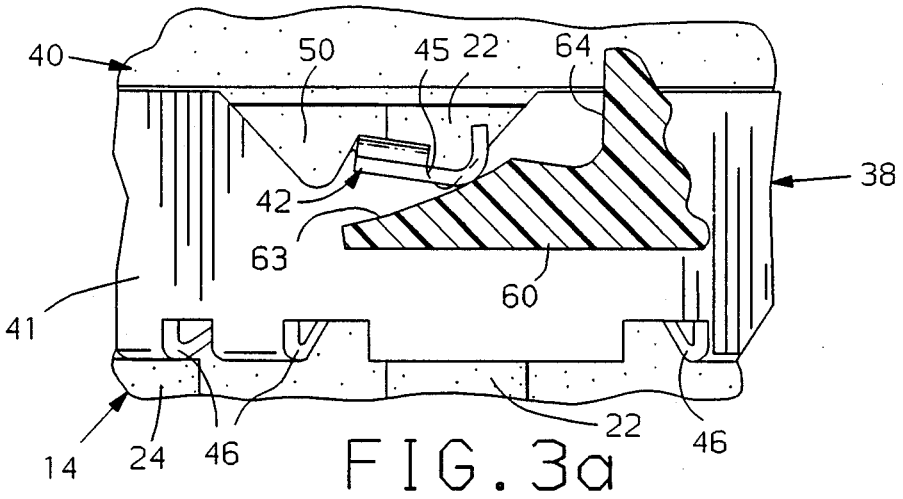
Figure 3B:
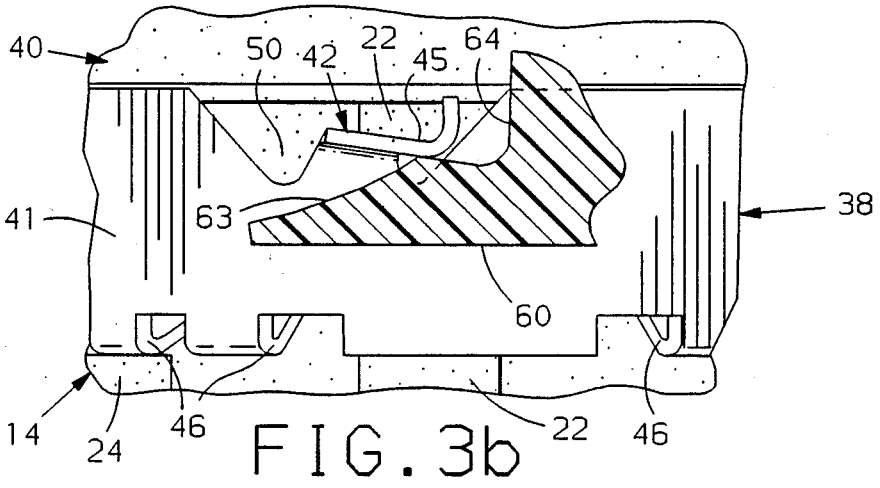
Figure 3C:
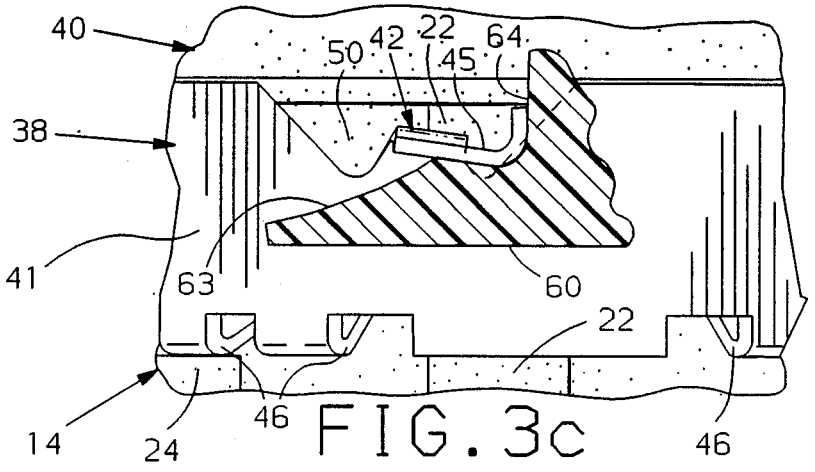
Figure 4:
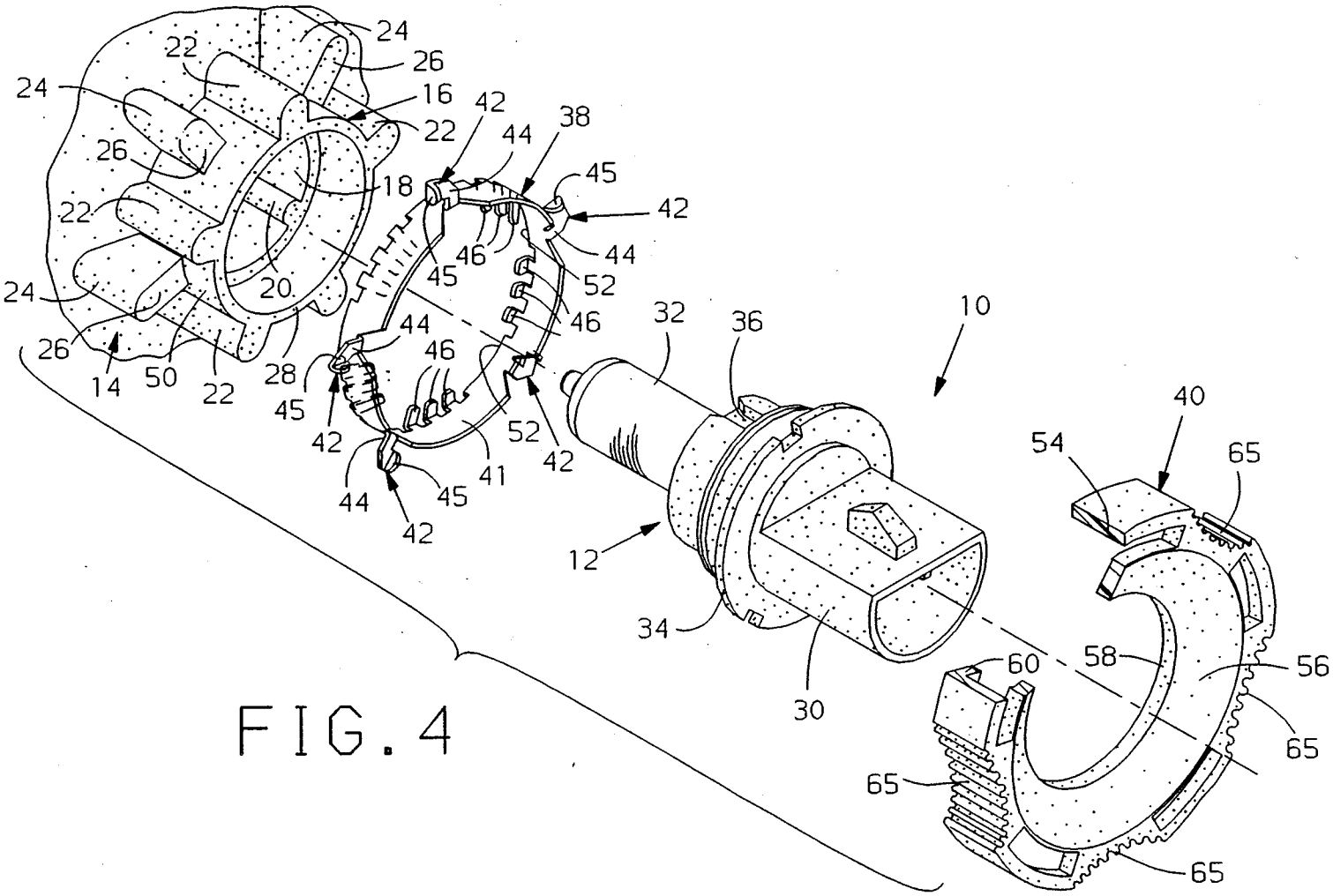

FIGS. *3a*, *3b*, and *3c* are enlarged sectional views showing the cooperation between one of the spring arms of the grip member and one of the ramp members of the lock nut as the lock nut is rotated to the locked position of FIG. 2; and FIG. 4 is an exploded isometric view showing the light bulb and the two parts of the retaining arrangement seen in FIGS. 1 through 3.

Referring now to the drawings and more particularly FIGS. 1 and 4 thereof, a retaining arrangement 10 is shown for maintaining a replaceable headlamp bulb assembly 12 within a socket formed in the rear of a headlamp reflector 14 which is made of a plastic material. The socket is defined by a cylindrical boss 16 which is integrally formed with he body of the reflector 14 and has a circular opening 18 provided with three circumferentially spaced and axially extending ribs 20 (one of which is shown in FIG. 4). The outer peripheral surface of the boss 16 also has a plurality of circumferentially spaced ribs 22 integrally formed thereon adjacent each of which is a locator member 24 integral with the boss 16 and provided with a stop surface 26. The stop surfaces 26 are located in a predetermined plane which is substantially normal to the longitudinal center axis of the opening 18. The boss 16 terminates with an end surface 28 also located in a plane substantially normal to the aforesaid axis of the opening 18.

The bulb assembly 12 is of the conventional replaceable type having a molded plug body 30 which retains the base of a lamp 32. As seen in FIG. 4, the plug body 30 of bulb assembly 12 is formed with an annular flange 34 and has three circumferentially spaced and longitudinally extending grooves 36 (one of which only is shown in FIG. 4) which are sized and angularly spaced so as to be complementary to the ribs 20 and thereby allow the plug body 30 to be located in the opening 18 of the boss 16 in the desired predetermined angular position relative to the boss. In this regard, it will be noted that when the bulb assembly 12 is located in the opening 18 of the boss 16, the flange 34 is in contact with the end surface 28 of the boss 16 to position the lamp axially relative to the reflector 14. Also, the bulb assembly 12 is retained in this position by the retaining arrangement 10 which includes a grip member 38 and a hand operated lock nut 40.

More specifically and as seen in FIGS. 2, *3a–3c*, and 4, the grip member 38 includes a cylindrical ring portion 41 made of a metallic material and has a plurality of identical circumferentially equally spaced spring arms 42 integrally formed on the periphery thereof. As best seen in FIGS. 2 and 3, each spring arm 42 comprises a radially outwardly extending connecting portion 44 integrally formed with an L-shaped spring section 45. The ring portion 41 is the rigid support part of the grip member 38 and includes integrally formed therewith a plurality of radially inwardly extending blades 46 the free ends of which lie on a circle having a common center with the outer surface of the ring portion 41 and a diameter which measures less than the diameter of the outer surface 50 of the boss 16. As seen in FIG. 2, the blades 46 are located in sets of at least three blades 46 with each set being separated from the adjacent set by an open space 52. Although not shown, it will also be noted that free ends of the blades 46 are inwardly angled slightly towards the spring arms 42. The spaces 52 are angularly separated from each other and located in the same relative positions as the ribs 22 formed on the boss 16. Thus as seen in FIG. 4, in mounting the grip member 38 onto the boss 16, the spaces 52 are first aligned with the ribs 22, and the grip member 38 is pressed onto the boss 16 until it is in contact with each of the end surfaces 26 of the locator members 24. As the grip member 38 is forced onto the boss 16, the free ends of the blades 46 cut into the outer cylindrical surface 50 of the boss 16 and lock onto the boss 16. Because the blades 46 are angled as seen in FIG. 1, they prevent the grip member 38 from being removed and serve to securely fasten the grip member 38 to the boss 16.

As alluded to hereinbefore, the lock nut 40 is adapted to cooperate with the grip member 38 for maintaining the bulb assembly 12 within the socket of the reflector 14. As seen in FIGS. 1, 2, and 4, the lock nut 40 is a molded plastic part that is cup shaped as seen in cross section in FIG. 1, and includes an axially extending rim 54 integral at its rear end with a inwardly extending frusto conical contact section 56 having an annular contact edge 58. The front end of the rim 54, at circumferentially spaced points, is formed with a radially inwardly extending wall 60 in each of which is formed with an access slot 62. The inside of each wall 60 is integrally formed a ramp 63, as seen in FIG. 3, which merges with a stop surface 64. The circumferentially spaced ramps 63 cooperate with the spring arms 42 of the grip member 38 as will be explained hereinafter. In addition, the rim 54 is formed with a plurality of circumferentially spaced concave and ribbed sections 65 which facilitate finger operated rotation of the lock nut 40.

From the above description and particularly as seen in FIG. 1, it should be apparent that after the bulb assembly 12 is inserted into the socket of the boss 16, the lock nut 40 encircles the plug body 30 of bulb assembly 12 is then manually located with its access slots 62 aligned with the spring arms 42 of grip member 38 and then is bodily moved axially to cause the spring arms 42 to be received by the slots 62. At the same time, the contact edge 58 will contact the flange 34 of the bulb assembly 12. The lock nut 40 is then rotated in a clockwise direction causing the ramp 63 to initially engage the associated spring arm 42 as seen in FIG. 3*a*, and upon continued rotation, cause the spring section 45 to flex and be drawn axially towards the contact section 56 of the lock nut 40, as seen in FIG. 3*b*, until the section 45 contacts the stop surface 64, as seen in FIG. 3*c*. This then causes the rigid contact section 56 to apply an axial force onto the flange 34 through the contact edge 58 forcing the flange 34 into firm contact with the end surface 28 of the boss 16. In this manner the lock nut 40 is locked onto the grip member 38 and through the spring arms 42 serves to firmly maintain the bulb assembly 12 within the socket of the reflector 14.

Various changes and modifications can be made in the above described invention without departing from the spirit of the invention. Accordingly the inventors do not wish to be limited except by the scope of the appended claims.

What is claimed:

1. A retaining arrangement for maintaining a bulb assembly within a socket located in the rear of a vehicle headlamp reflector, said bulb assembly having an annular flange, said socket being defined by a cylindrical boss having an opening for receiving said bulb assembly with said flange located in a predetermined angular position in engagement with the terminal end of said boss, said retaining arrangement including a metal grip member including a cylindrical ring portion having a plurality of blades integrally formed therewith and extending radially inwardly from said ring portion for permitting said grip member to be press fitted onto said cylindrical boss and maintained thereon, a plurality of circumferentially spaced spring arms, each of said spring arms being formed integrally on the peripheral surface of said ring portion and including a connecting portion and an L-shaped spring section, and an annular lock nut having a rim the front end of which is formed with a radially inwardly extending wall, a plurality of circumferentially spaced slots formed in said wall, a ramp formed on the inside of said wall adjacent each slot, the rear end of said lock nut being integrally formed with a contact section having an annular contact edge, said lock nut adapted to be mounted on said grip member so that the slots receive the spring arms after which the lock nut is rotated so the ramp contacts said spring section and causes said spring section to flex and to move axially towards said contact section and allow said contact edge to press the flange of said bulb assembly firmly into engagement with said terminal end of said boss.

2. A retaining arrangement for maintaining a bulb assembly within a socket located in the rear of a vehicle headlamp reflector, said bulb assembly having an annular flange, said socket being defined by a cylindrical boss having an opening for receiving said bulb assembly with said flange located in a predetermined angular position in engagement with the terminal end of said boss, said retaining arrangement including a metal grip member including a cylindrical ring portion having a plurality of blades integrally formed therewith and extending radially inwardly from said ring portion for permitting said grip member to be press fitted onto said cylindrical boss and maintained thereon, a plurality of circumferentially spaced spring arms, each of said spring arms being formed integrally on the peripheral surface of said ring portion and including a radially extending connecting portion and an L-shaped spring section, and an annular plastic lock nut having a rim the front end of which is formed with a radially inwardly extending wall, a plurality of circumferentially spaced slots formed in said wall, a ramp and a stop surface formed on the inside of said wall adjacent each slot, the rear end of said lock nut being integrally formed with a frusto conical contact section having an annular contact edge, said lock nut adapted to be mounted on said grip member so that the slots receive the spring arms after which the lock nut is rotated so the ramp contacts said spring section and causes said spring arms to flex and to move axially towards said contact section after which said spring section contacts said stop surface and allows said contact edge to press the flange of said bulb assembly firmly into engagement with said terminal end of said boss.

* * * * *